US005569123A

United States Patent [19]

Creatchman

[11] Patent Number: 5,569,123

[45] Date of Patent: Oct. 29, 1996

[54] DEVICE FOR EXERCISING IN A DOORFRAME

[76] Inventor: Jeff Creatchman, 4222 Prince Charles, Laval, Québec, Canada, H7W 1Z2

[21] Appl. No.: 503,562

[22] Filed: Jul. 18, 1995

[51] Int. Cl.[6] ..... A63B 1/00

[52] U.S. Cl. ..... 482/39; 482/40; 482/904

[58] Field of Search ..... 482/904, 37, 39, 482/40; 403/328

[56] References Cited

U.S. PATENT DOCUMENTS

| | | | |
|---|---|---|---|
| 488,113 | 12/1892 | Bushee . | |
| 618,990 | 2/1899 | Lubben | 482/904 |
| 1,670,390 | 5/1928 | Strom . | |
| 2,919,134 | 12/1959 | Zuro . | |
| 3,156,465 | 11/1964 | Jacobi . | |
| 3,342,484 | 9/1967 | Christensen . | |
| 3,374,859 | 3/1968 | Dobert . | |
| 3,457,786 | 7/1969 | Trent . | |
| 3,525,521 | 8/1970 | Sylvester . | |
| 3,526,399 | 9/1970 | Hjelte . | |
| 3,707,303 | 12/1972 | Petri | 403/328 |
| 3,738,650 | 6/1973 | Ossenkop et al. . | |
| 3,740,083 | 6/1973 | Zenhausern . | |
| 4,360,198 | 11/1982 | Waulters . | |
| 4,458,894 | 7/1984 | Dudley . | |
| 4,473,225 | 9/1984 | Miller . | |
| 4,516,749 | 5/1985 | Sullivan . | |
| 4,772,011 | 9/1988 | Guridi . | |
| 4,775,056 | 10/1988 | Inglis . | |
| 4,941,232 | 7/1990 | Decker et al. . | |
| 4,974,836 | 12/1990 | Hirsch . | |
| 5,072,934 | 12/1991 | Blanes . | |
| 5,176,602 | 1/1993 | Roberts . | |
| 5,180,350 | 1/1993 | Thomas . | |
| 5,186,696 | 2/1993 | Pfefferle et al. . | |
| 5,221,240 | 6/1993 | Mann et al. . | |

FOREIGN PATENT DOCUMENTS

| | | |
|---|---|---|
| 618746 | 4/1961 | Canada . |
| 940956 | 1/1974 | Canada . |
| 2747541 | 4/1979 | Germany . |
| 27262 | 4/1911 | Sweden . |
| 629671 | 5/1982 | Switzerland . |

*Primary Examiner*—Lynne A. Reichard

*Attorney, Agent, or Firm*—Merchant, Gould Smith, Edell Walter & Schmidt

[57] ABSTRACT

The device is used for exercising in a doorframe for mainly developing triceps and biceps muscles. The device comprises a pair of independent handles and at least one pair of brace members secured to vertical sides of the doorframe. The brace members of each pair are connected to opposite vertical sides and are substantially facing each other. Each brace member comprises a boss provided with a bore for removably receiving a holding portion of a corresponding handle. The exercising device leaves to a suitable space for the upper body of the user during the exercises. It is also removable quickly and easily from the doorframe once the workout is finished for getting the handles out of the way.

3 Claims, 3 Drawing Sheets

DEVICE FOR EXERCISING IN A DOORFRAME

FIELD OF THE INVENTION

The present invention relates to a device for exercising in a doorframe and more particularly to an exercise handle mount for simple and easy installation.

BACKGROUND OF THE INVENTION

All kinds of apparatus for exercising have been developed for many years, particularly apparatus for exercising in a doorframe. They generally allow people to reinforce their triceps and biceps muscles. Prior art attempts at such apparatus usually comprise a full chin-up bar, permanently or temporarily connected to the doorway jamb. These bars are generally difficult to remove and do not allow exercises which require the body to be between the handles.

For the foregoing reasons, there is a need for an exercising device for quick and easy installation in a doorframe and that also allows exercises which require the body to be between the handles.

SUMMARY OF THE INVENTION

The present invention is directed to a device for exercising in a doorframe that satisfies the above-mentioned needs. A device for exercising in a doorframe having features of the present invention comprises:

a pair of independent handles, each handle comprising a gripping portion and a holding portion; and at least one pair of brace members secured to vertical sides of the doorframe, the brace members of each pair being connected to opposite vertical sides and substantially facing each other, each brace member comprising a boss provided with a bore for removably receiving the holding portion of a corresponding handle.

A non restrictive description of a preferred embodiment will now be given with reference to the appended drawings.

IDENTIFICATION OF THE COMPONENTS

Figure 1:
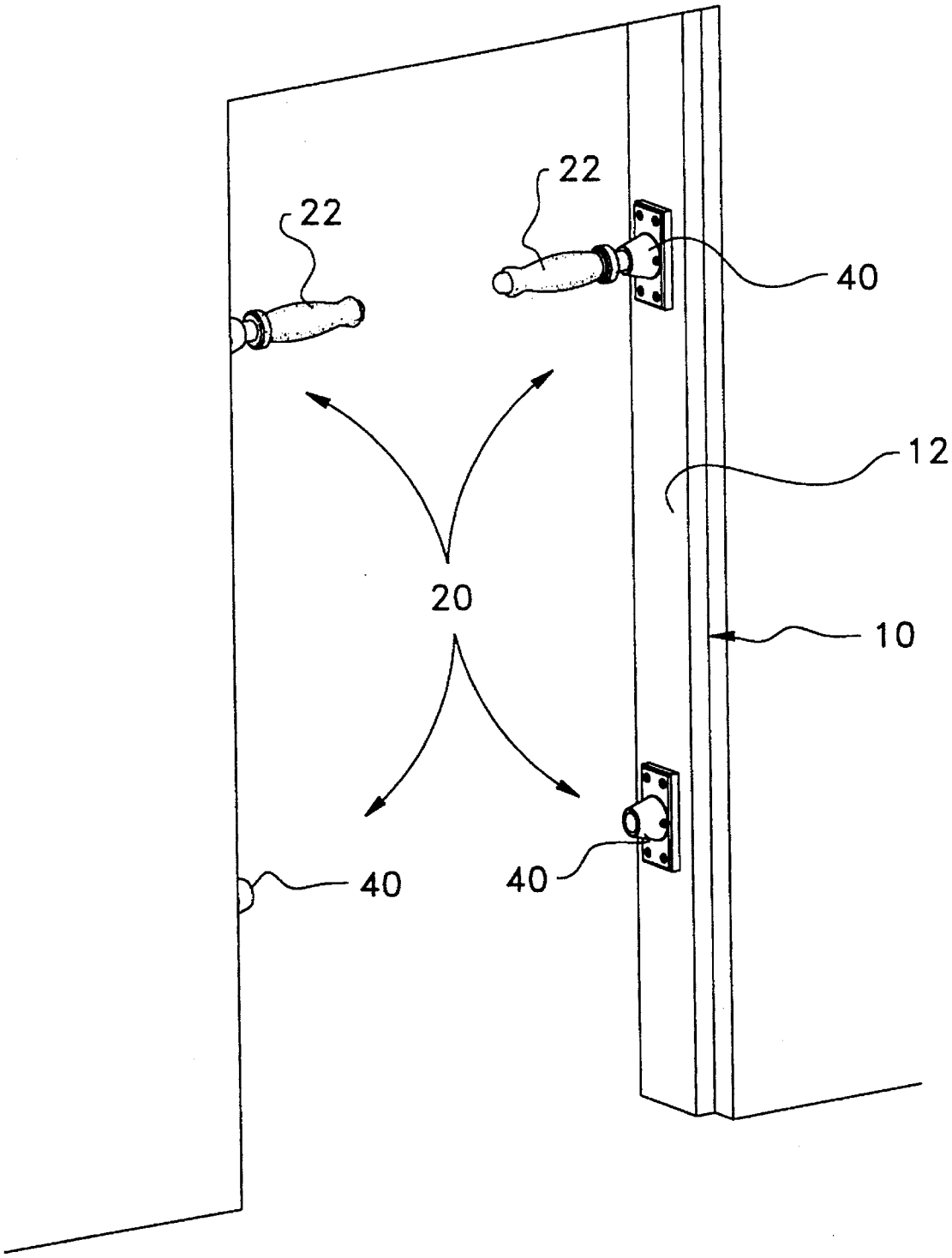
FIG. 1 is a perspective view showing a doorframe with an exercising device according to the present invention.

The drawings and description of the preferred embodiment use the following reference numerals:

10 doorframe
12 vertical sides
20 device
22 handles
24 gripping portions
26 holding portions
28 non-slip sleeves
30 circular grooves
32 flanges
40 brace members
42 bosses

44 bores
46 back flanges
48 holes
50 screws
52 radial channels
54 balls
56 springs
58 bolts

DESCRIPTION OF A PREFERRED EMBODIMENT

Referring in detail to the figures of the drawings, there is shown a device (20) for exercising in a doorframe (10) which embodies the features of the present invention. The device (20) comprises a pair of independent handles (22). The handles (22) are preferably comprising a rigid elongated bar divided in a gripping portion (24) and a holding portion (26). The gripping portion (24) is where the user puts his or her hands during the exercises. It is preferably covered by a non-slip sleeve (28), made for example of neoprene. The holding portion (26) is what connects the handles (22) to the brace members (40) as described hereinafter.

The device (20) comprises at least one pair of brace members (40) secured to vertical sides (12) of the doorframe (10). The brace members (40) of each pair are connected to opposite vertical sides (12) and are substantially facing each other, as shown in FIG. 1. The exact number of pairs of brace members (40) depends on the needs of the user, more particularly the kind of exercises to do. It is found suitable that only one pair of handles (22) be provided, regardless of the number of pairs of brace members (40). The user will only have to switch the position of the handles (22) between exercises, as required.

Each brace member (40) comprises a frusto-conical boss (42) provided with a central bore (44) for removably receiving the holding portion (26) of a corresponding handle (22). The holding portions (26) and the bores (44) have of course a corresponding cross-section, preferably circular. Other kinds of cross-sections are also suitable. The tolerance between the holding portions (26) and the bores (44) should be relatively small for a better stability, as apparent for a person skilled in the art.

Each brace member (40) may comprise a back flange (46) provided with holes (48) for connecting the brace member (40) to the doorframe (10) by screws (50). Alternately, glue, nails, rivets or the like can be used for the same purpose, as long as the connection is strong enough to suitably support the weight of a user.

Figure 2:
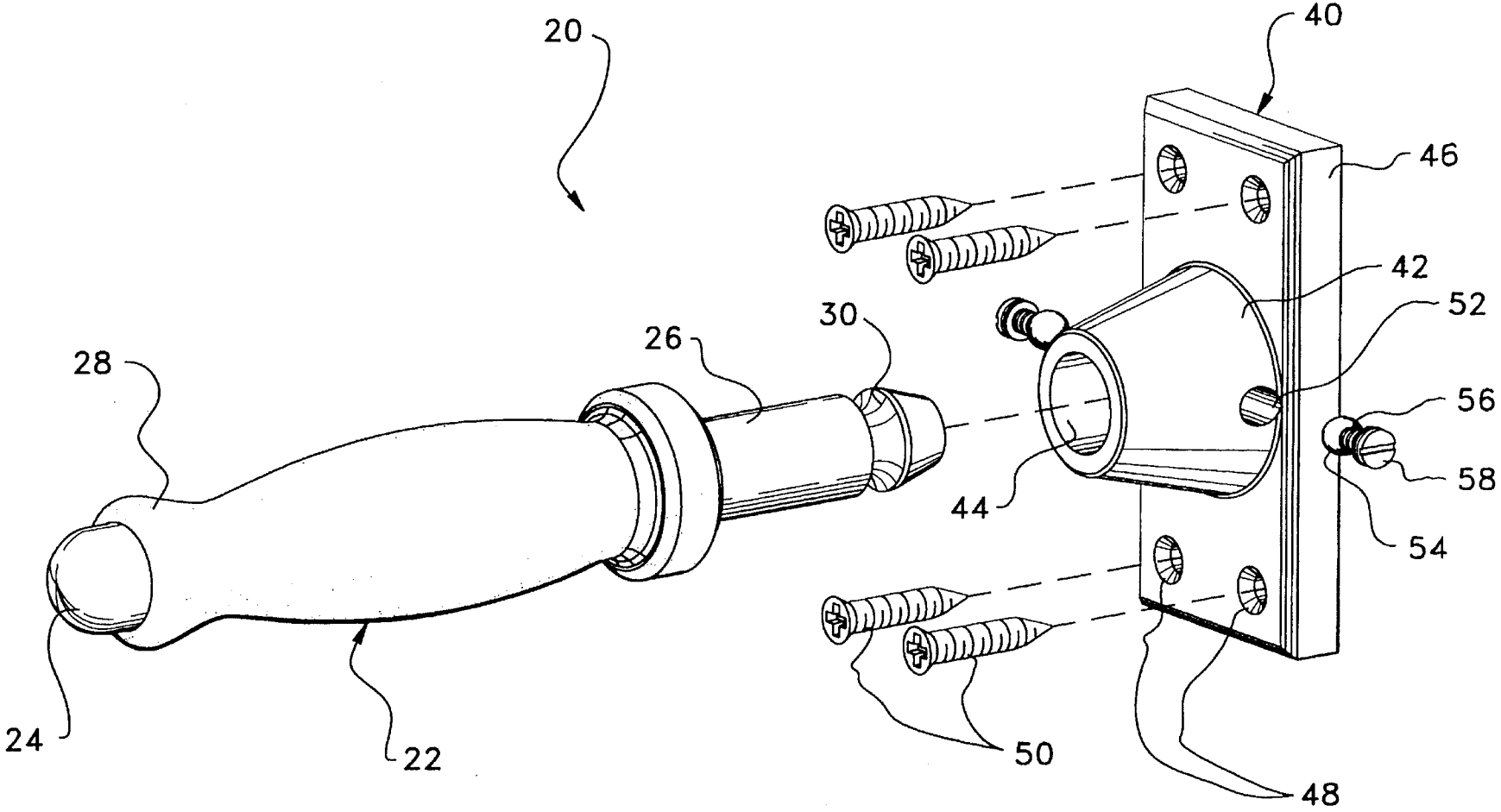
FIG. 2 is an exploded perspective view of the exercising device shown in FIG.1.
Figure 3:
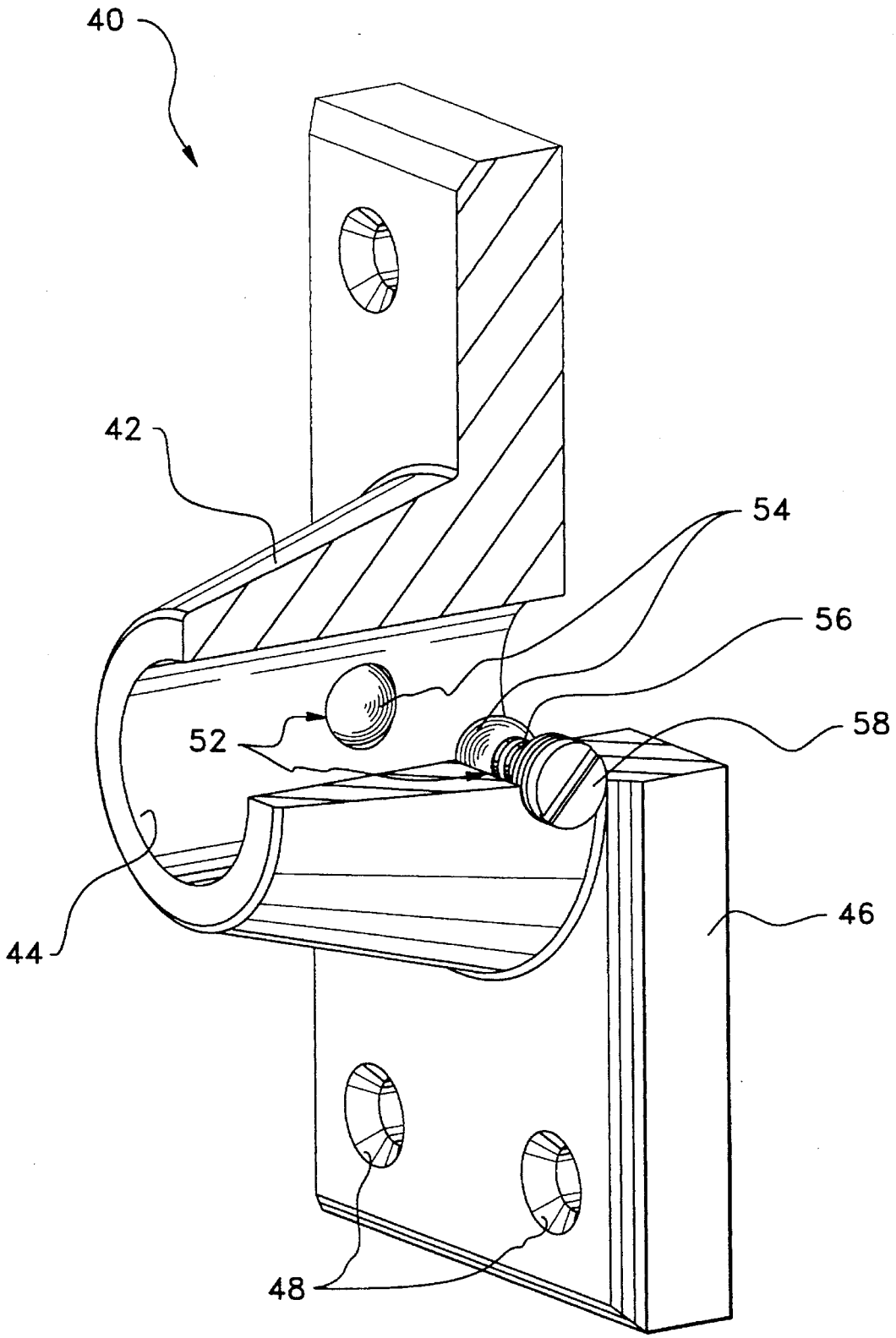
FIG. 3 is a perspective view of one of the brace members shown in FIGS. 1 and 2, with a cutaway portion showing the interior thereof.

According to a preferred embodiment, each brace member (40) is further comprising locking means for holding the holding portion (26) of the handles (22) inside their corresponding bores (44). As shown in FIGS. 2 and 3, the locking means may comprise at least one ball (54) located in an end of a radial channel (52) in the brace member (40) and inwardly biased by a spring (56). Each ball (54) has a portion partially emerging inside the bore (44) and is prevented from moving further inside the bore (44) by a shoulder or a striction (not shown) at the end of the bore (44), as apparent to a person skilled in the art.

Preferably, the holding portion (26) of each handle (22) comprises a circular groove (30) for receiving the emerging portion of the ball or balls (54) once in position in the bore (44), and thereby preventing removal of the handles (22), unless the handles are axially pulled relatively forcefully for dislodging the ball or balls (54).

As can be understood, the device (20) allows exercises which require the body of a person to be between the handles (22), thereby allowing different types of exercises for reinforcement of different muscles. One of the advantages of the device (20) is that the handles (22) are independent, leaving to a suitable space for the upper body of the user during the exercises. The device (20) also has the advantages of being easily connectable at different heights on the doorframe (10), depending on the locations and the number of pairs of brace members (40), and of being removable quickly and easily from the doorframe (10) once the workout is finished for getting the handles (22) out of the way.

Although a preferred embodiment of the invention has been described in detail herein and illustrated in the accompanying drawings, it is to be understood that the invention is not limited to this precise embodiment and that various changes and modifications may be effected therein without departing from the scope or spirit of the invention.

What is claimed is:

1. A device for exercising adapted to be secured to vertical sides of a doorframe, the device comprising:

a pair of independent handles, each handle comprising a rigid elongated bar and having a gripping portion and a holding portion;

a pair of non-slip sleeves, each sleeve covering the gripping portion of a corresponding handle;

at least one pair of brace members being adapted to be connected to opposite vertical sides of the doorframe, the brace members of each pair substantially facing each other, each brace member comprising:

a back flange provided with holes for connecting the brace member to the doorframe by screws; and a boss provided with a bore for removably receiving the holding portion of a corresponding handle; and locking means for holding the holding portion of the handles inside their corresponding bore, each locking means comprising at least one inwardly biased ball located at an end of a radial channel in the brace member and having a portion emerging inside the bore, each holding portion of the handles comprising a surface groove for receiving the emerging portion of the corresponding ball and thereby preventing removal of the handles unless the handles are axially pulled relatively forcefully.

2. A device according to claim 1, wherein the boss and the back flange of each brace member are integrally formed into one piece.

3. A device for exercising adapted to be secured to vertical sides of a doorframe, the device comprising:

a pair of independent handles, each handle comprising a gripping portion and a holding portion; and at least one pair of brace members being adapted to be connected to opposite vertical sides of the doorframe, the brace members of each pair substantially facing each other, each brace member comprising:

a back flange provided with holes for connecting the brace member to the doorframe by screws; and a boss integrally connected to the back flange and provided with a bore for removably receiving the holding portion of a corresponding handle.

* * * * *